United States Patent [19]

Ueda et al.

[11] Patent Number: 4,999,971

[45] Date of Patent: Mar. 19, 1991

[54] PACKAGING MACHINE

[75] Inventors: Kazuo Ueda; Seizo Kawamura, both of Tokushima, Japan

[73] Assignee: Shikoku Kakoki Co., Ltd., Tokushima, Japan

[21] Appl. No.: 479,925

[22] Filed: Feb. 14, 1990

[30] Foreign Application Priority Data

Feb. 17, 1989 [JP] Japan ..... 1-18070[U]

[51] Int. Cl.[5] ..... B65B 1/00; B65B 51/32

[52] U.S. Cl. ..... 53/266.1; 53/370.7; 53/387.4; 493/470

[58] Field of Search ..... 53/266 R, 282, 373, 53/375, 379, 388, 564, 565; 198/735, 952; 493/130, 133, 135, 184, 470

[56] References Cited

U.S. PATENT DOCUMENTS 3,241,291 3/1966 Monroe et al. ..... 53/375 X
3,566,575 3/1971 Lisiecki ..... 53/266 X
3,619,979 11/1971 Martensson et al. ..... 53/375 X
3,751,876 8/1973 Oakley et al. ..... 53/375
4,840,009 6/1989 Rentmeester et al. ..... 53/373

*Primary Examiner*—John Sipos
*Assistant Examiner*—Daniel Moon
*Attorney, Agent, or Firm*—Armstrong, Nikaido, Marmelstein, Kubovcik & Murray

[57] ABSTRACT

A packaging machine for filling a fluid food or like contents into containers fed to a conveyor and each coated with a thermoplastic synthetic resin over the outer surface thereof and thereafter closing the containers while the containers are being transported by the conveyor. The container transport path has at an intermediate portion thereof a station where hot air is applied to each container, for example, for heat sealing. The conveyor is provided with rails for guiding the container by supporting the bottom thereof. If the rails are heated with the hot air, the resin is likely to adhere to the rails on melting. The rails are provided with a cooling water channel for cooling the rails to eliminate this drawback.

2 Claims, 3 Drawing Sheets

PACKAGING MACHINE

BACKGROUND OF THE INVENTION

The present invention relates to packaging machines, and more particularly to a machine adapted to fill a fluid food or like contents into containers and thereafter close the containers while the containers are being transported by a conveyor.

Conventional packaging machines of the type mentioned comprise a container transport conveyor, and a group of devices arranged in series along the path of travel of the conveyor for filling contents into containers each covered with a thermoplastic resin over its outer surface and thereafter closing the containers. The conveyor has container holders each adapted to hold the container so that the container is restrained from moving horizontally while being allowed to move vertically, and a rail extending below and in parallel to the path of movement of the container holders for supporting the bottom of the container held by each holder to guide the container. The group of devices includes a heater for applying hot air to the container for sterilization or heat sealing.

It is likely that the hot air from the heater will heat not only the container but also the rail. The thermoplastic resin covering the outer surface of the container then adheres to the rail upon melting due to the heat of the rail, giving rise to the problem that the adhering resin offers resistance to make the rail unable to guide the container smoothly. The adhesion of the resin also involves the problem of being undesirable for sanitation.

SUMMARY OF THE INVENTION

The main object of the present invention is to provide a packaging machine free of these problems.

The present invention provides a packaging machine for filling contents into tubular containers each coated with a thermoplastic synthetic resin over the outer surface thereof and thereafter closing the top of each container while the containers are being transported along a specified path, the machine comprising holding means movable along the container transport path and each adapted to hold the container so that the container is restrained from moving horizontally while being allowed to move vertically, a group of devices arranged in series along the path of movement of the holding means and including a filling device and a heater, the heater being disposed downstream from the filling device with respect to the direction of movement of the holding means for applying hot air to each container to close the top of the container by heat sealing, and rail means extending below and in parallel to the path of movement of the holding means for guiding the containers held by the holding means by supporting the bottom of each of the containers, the rail means having a cooling water channel over the entire length thereof or at a required portion thereof opposed to the heater.

With the packaging machine of the present invention, a cooling water channel is provided over the entire length of the rail means or at the required portion thereof corresponding or opposed to the heater, so that when cooling water is passed through the channel, the rail means is cooled with the water and will not be heated even if the rail means is exposed to the hot air from the heater.

This prevents the thermoplastic resin coating the container from adhering to the rail means.

DESCRIPTION OF THE PREFERRED EMBODIMENTS

Embodiments of the invention will be described below with reference to the accompanying drawings.

Figure 6:
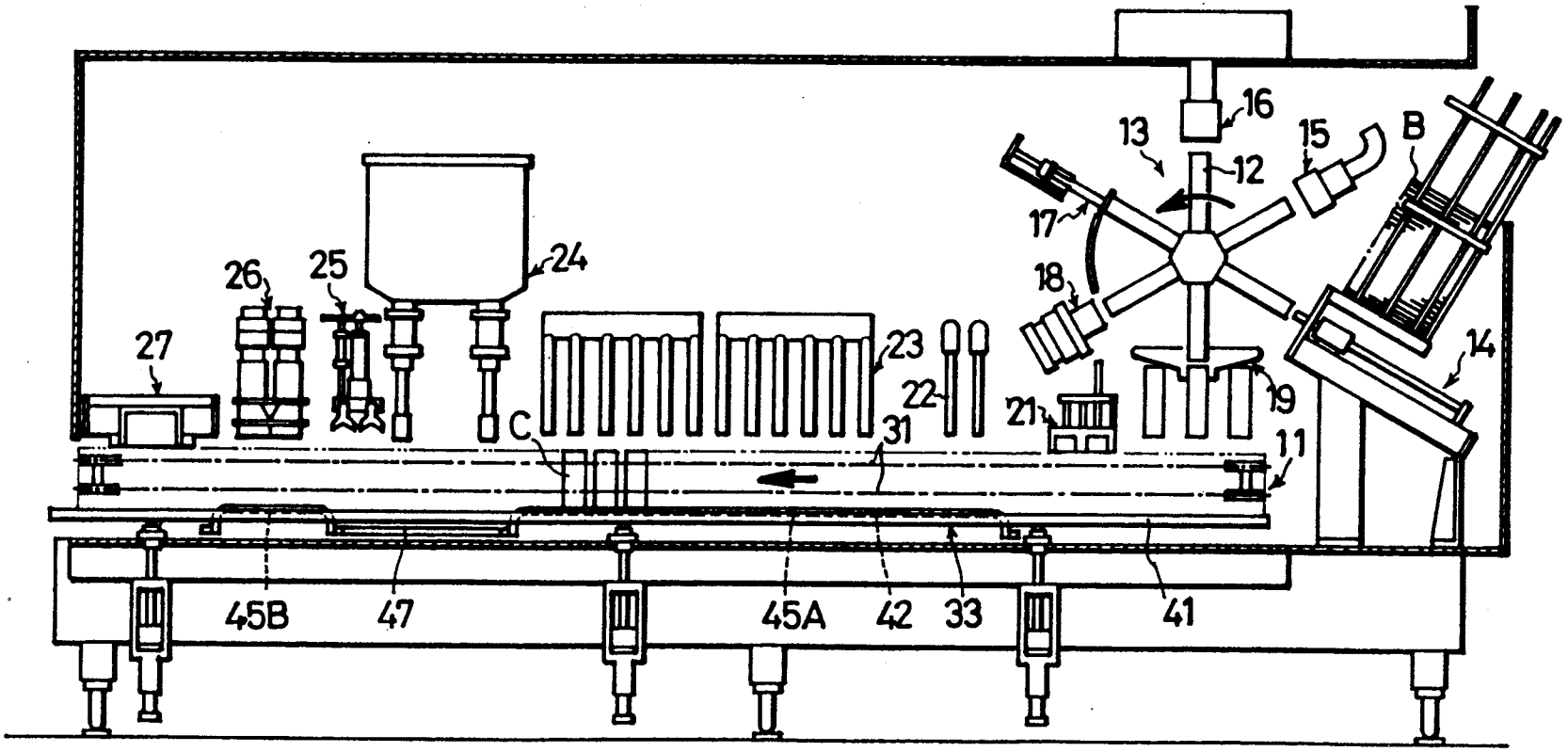
FIG. 6 is a schematic side elevation showing a packaging machine in its entirety.

FIG. 6 schematically shows a packaging machine in its entirety. The packaging machine is adapted for use with container blanks B made of paper-base laminate having a thermoplastic resin layer over each of its inner and outer surfaces although not shown in detail.

An intermittently driven rotary body 13 having six mandrels 12 is disposed above the starting end of a path of transport afforded by a container transport conveyor 11. Arranged around the rotary body 13 one after another are a feeder 14, primary bottom heater 15, secondary bottom heater 16, bottom breaker 17, bottom sealing device 18 and transfer device 19 at six stations, respectively, where the mandrels 12 stop. By means of these devices which are well known and therefore will not be described in detail, container blanks B, each folded to a flat shape and shapable into a tubular form of square to rectangular cross section, are each unfolded into the tubular form and then closed at one end to form a container C having a bottom, which is thereafter delivered to the conveyor 11.

Arranged in series from a position immediately adjacent the starting end of transport path of the conveyor 11 to the terminal end thereof are a primary top breaker 21, nozzles 22 for spraying a hydrogen peroxide aqueous solution, hot air nozzles 23, filling device 24, secondary top breaker 25, top heater 26 and top sealing device 27. By means of these devices which are well known and therefore will not be described in detail, each container C is sterilized, contents are filled into the container C, and the top portion of the container C is thereafter folded to the shape of a gabled roof and closed.

Figure 1:
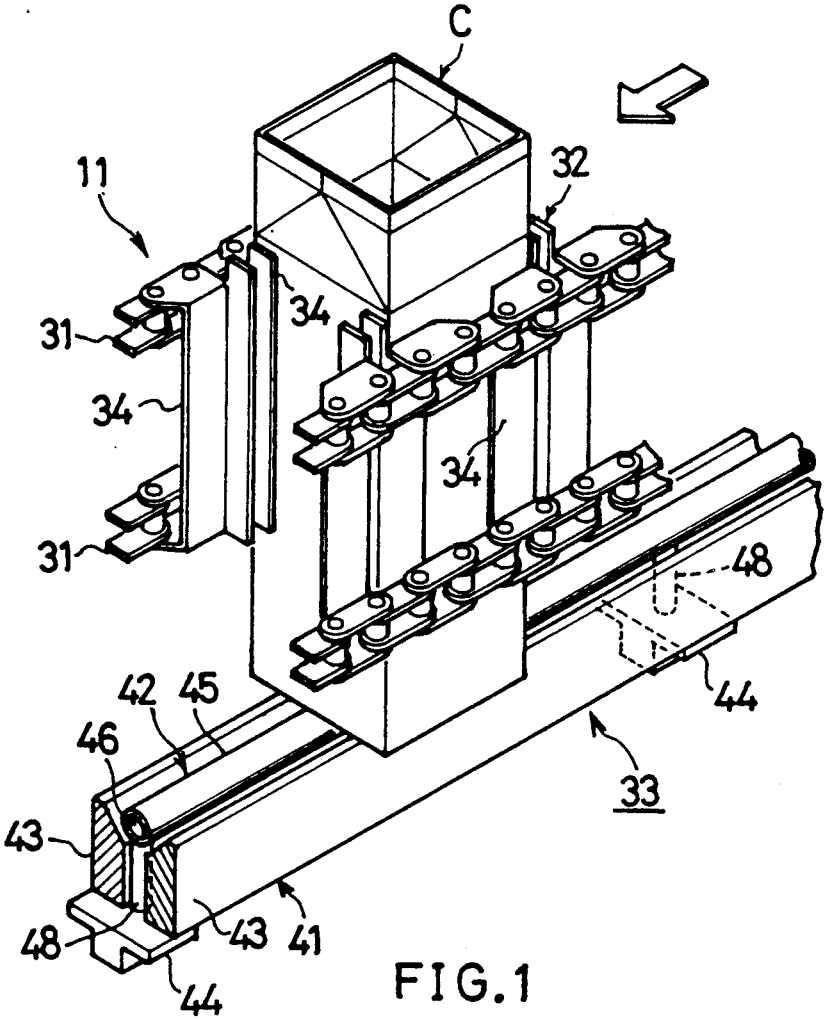
FIG. 1 is a perspective view of a container transport conveyor.
Figure 2:
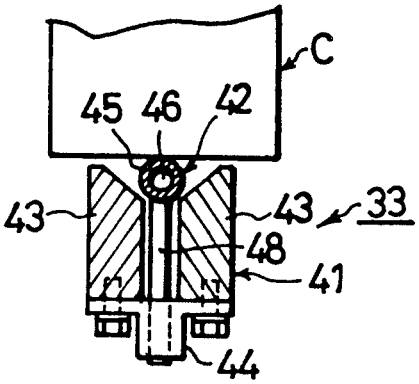
FIG. 2 is a sectional view showing rails.

With reference to FIGS. 1 and 2, in addition to FIG. 6, the container transport conveyor 11 comprises a pair of horizontal endless chains 31 arranged side by side, a multiplicity of container holders 32 attached to these chains 31 at a spacing, and rails 33 for guiding the containers C held by the holders 32 by supporting the bottom of each container.

Each of the container holders 32 comprises four vertical pieces 34 each having an L-shaped horizontal section and attached as directed outward to the chain 31. Two adjacent vertical pieces 34 on one of the chains 31 and two adjacent vertical pieces 34 positionable as opposed to these pieces 34 and attached to the other chain 31, i.e., four vertical pieces 34 in all, engage the respective corners of the container C, whereby the container C is so held by the holder 32 that it is restrained from moving horizontally while being allowed to move vertically.

The rails 33 are of two kinds; one is a main rail 41, and the other a subrail 42. The main rail 41 comprises a pair of platelike elongated members 43 having a rectangular cross section, arranged in parallel and spaced apart widthwise thereof. The two elongated members 43 extend below the path of movement of the container holders 32 over the entire length of the path. The two elongated members 43 have upper surfaces slanting downward toward the middle of the width of the main rail 41. The subrail 42 comprises a pipe 45 positioned between the slanting upper surfaces of the elongated members 43, a plurality of posts 48 extending between the elongated members 43 and supporting the pipe 45 at suitable portions thereof, and mount members 44 secured to the lower ends of the respective posts 48 and attached to the lower surfaces of the elongated members 43 to interconnect these members 43. The hollow interior portion of the pipe 45 serves as a cooling water channel 46. With reference to FIG. 6, the pipe 45 includes a long pipe portion 45A disposed at the location where the solution spray nozzles 22 and the hot air nozzles 23 are provided, and a short pipe portion 45B disposed at the location where the top heater 26 is provided. The long and short pipe portions 45A and 45B are bent downward at their opposite ends. The opposed ends of the two pipe portions 45A, 45B are interconnected by a connecting pipe 47 in communication with each other.

With reference to FIG. 2, the top surface of the subrail 42 is positioned at a slightly higher level than the top of the main rail 41. Consequently, the container C is supported by the subrail 42 in place of the main rail 41 at the locations where the subrail 42 is provided, and is supported by the main rail 41 where the subrail 42 is absent.

Cooling water is supplied to and discharged from the two pipe portions 45A and 45B by unillustrated means, whereby the subrail 42 is given a self-cooling function. As a result, the temperature of the subrail 42 will not rise even if the heat from the hot air nozzles 23 and the top heater 26 heats the subrail 42 and raises the temperature of the main rail 41.

Figure 3:
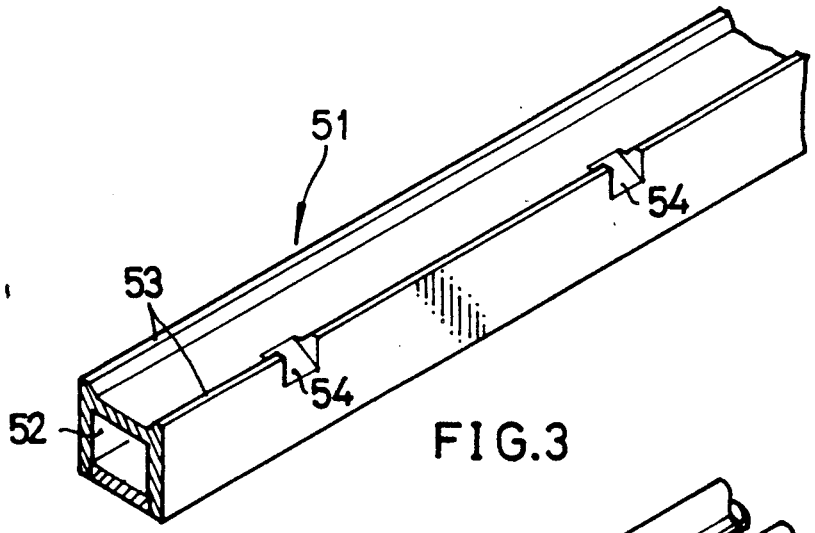
FIGS. 3 to 5 are perspective views showing different modifications of rails.
Figure 4:
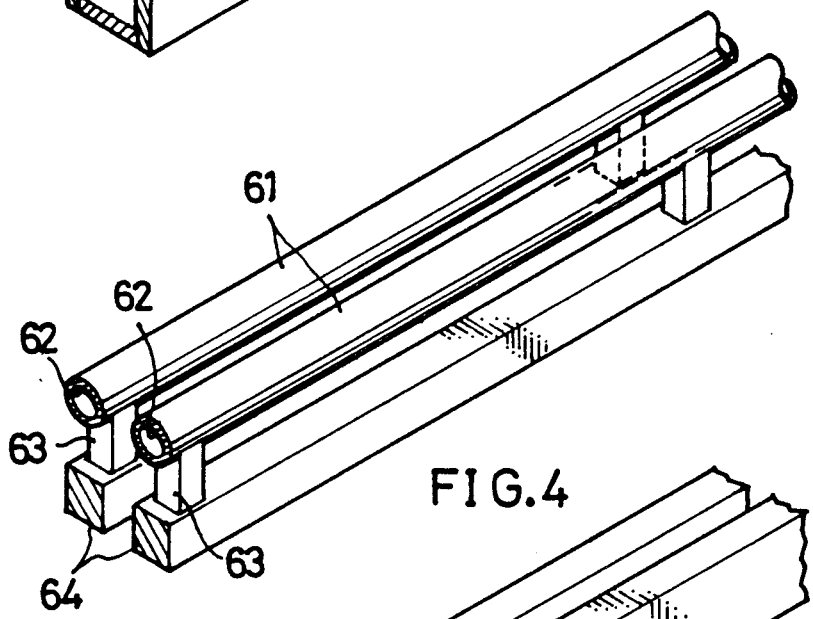
Figure 5:
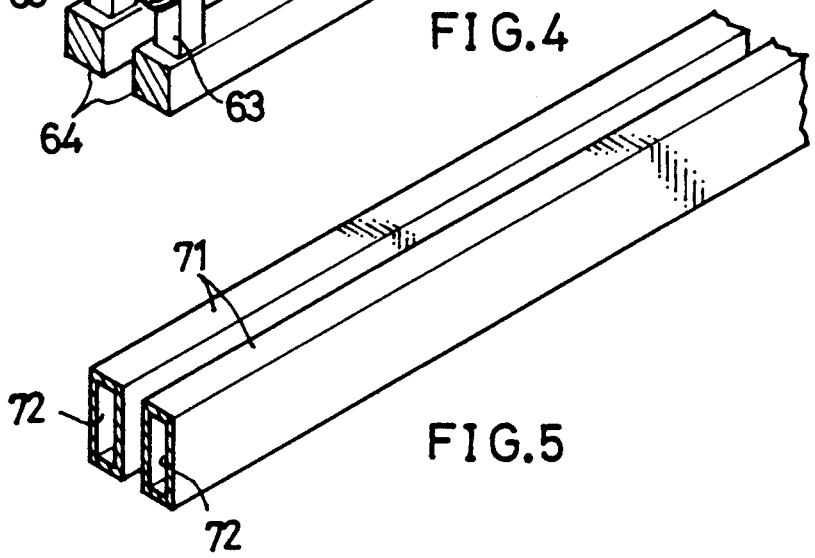

FIGS. 3 to 5 show different modifications of rails. The rail or rails of each modification to be described below are of a single kind and extend over the entire length of the path of movement of the container holders.

FIG. 3 shows a rail 51 in the form of a tube having an approximately square cross section. The interior of the rail 51 serves as a cooling water channel 52. Ridges 53 are formed at the respective opposite edges of upper surface of the rail 51. One of the ridges 53 is formed with drain cutouts 54.

FIG. 4 shows two rails 61 extending in parallel to each other and each in the form of a pipe. The interior of the rail 61 serves as a cooling water channel 62. The rail 61 is supported by a support bar 64 with spacers 63 provided therebetween.

FIG. 5 shows two rails 71 arranged in parallel to each other and each in the form of a tube having a rectangular cross section. The interior of each rail 71 serves as a cooling water channel 72.

What is claimed is:

1. A packaging machine for filling contents into tubular containers each coated with a thermoplastic synthetic resin over the outer surface thereof and thereafter closing the top of each container while the containers are being transported along a specified path, the machine comprising:

holding means movable along the container transport path and each adapted to hold the container so that the container is restrained from moving horizontally while being allowed to move vertically, a group of devices arranged in series along the path of movement of the holding means and including a filling device and a heater, the heater being disposed downstream from the filling device with respect to the direction of movement of the holding means for applying hot air to each container to close the top of the container by heat sealing, and rail means extending below and in parallel to the path of movement of the holding means for guiding the containers held by the holding means by supporting the bottom of each of the containers, said rail means including a pair of main rails each in the form of an elongated member and extending over the entire length of the path of movement of the holding means in parallel to and spaced apart from each other, and a subrail in the form of a pipe disposed between the main rails at a portion of said main rails opposed to the heater, the subrail having a cooling water channel in its interior and the top surface of the subrail being positioned at a higher level than top surfaces of the main rails.

2. A packaging machine for filling contents into tubular containers each coated with a thermoplastic synthetic resin over the outer surface thereof and thereafter closing the top of each container while the containers are being transported along a specified path, the machine comprising:

holding means movable along the container transport path and each adapted to hold the container so that the container is restrained from moving horizontally while being allowed to move vertically, a group of devices arranged in series along the path of movement of the holding means and including a sterilizer for spraying a sterilizing solution to each container and applying hot air to the container to dry and remove the solution, a filling device disposed downstream from the sterilizer with respect to the direction of movement of the holding means and a heater disposed downstream from the filling device with respect to the direction of movement of the holding means for applying hot air to each container to close the top of the container by heat sealing, and rail means extending below and in parallel to the path of movement of the holding means for guiding the containers held by the holding means by supporting the bottom of each of the containers, said rail means including a pair of main rails each in the form of an elongated member and extending over the entire length of the path of movement of the holding means in parallel to and spaced apart from each other, a first subrail in the form of a pipe and disposed between the main rails at a portion of said main rails opposed to the sterilizer, the first subrail having a cooling water channel in its interior, a second subrail in the form of a pipe and disposed between the main rails at a portion of said main rails opposed to the heater, the second subrail having a cooling water channel in its interior, and the top surfaces of the first and second subrails being positioned at a higher level than top surfaces of the main rails.

* * * * *